US006027323A

United States Patent [19]

Martensen et al.

[11] Patent Number: 6,027,323

[45] Date of Patent: Feb. 22, 2000

[54] HYDRAULIC VANE MACHINE

[75] Inventors: Lars Martensen, Sønderborg; Gunnar Lyshøj Hansen, Nordborg, both of Denmark

[73] Assignee: Danfoss A/S, Nordborg, Denmark

[21] Appl. No.: 09/015,113

[22] Filed: Jan. 29, 1998

[30] Foreign Application Priority Data

Jan. 29, 1997 [DE] Germany ..... 197 03 113

[51] Int. Cl.[7] ..... F01C 1/344; F04C 2/344

[52] U.S. Cl. ..... 418/267

[58] Field of Search ..... 418/267, 268, 418/79, 80, 81, 136, 137, 138

[56] References Cited

U.S. PATENT DOCUMENTS

| | | | |
|---|---|---|---|
| 3,254,570 | 6/1966 | Mazur | 418/268 |
| 3,255,704 | 6/1966 | Mazur | 418/268 |
| 3,279,387 | 10/1966 | McGill | 418/267 |
| 3,535,062 | 10/1970 | Jagger | 418/268 |
| 3,598,510 | 8/1971 | Aoki | 418/268 |
| 3,627,456 | 12/1971 | Gerlach | 418/268 |
| 4,376,620 | 3/1983 | Colston | 418/267 |
| 4,521,167 | 6/1985 | Cavalleri et al. | 418/268 |

*Primary Examiner*—Willis R. Wolfe
*Attorney, Agent, or Firm*—Lee, Mann, Smith, McWilliams, Sweeney & Ohlson

[57] ABSTRACT

A hydraulic vane machine has a rotor, in which several vanes are arranged radially movable, and a stator having a stator bore, whose wall is made as a guiding contour on which the vanes bear. It is intended to prolong the life of such a machine, even when the machine is operated with a poorly lubricating hydraulic fluid, such as water. For this purpose at least one vane has a wearing surface on the end bearing on the guiding contour. Further, a channel arrangement is provided between high pressure and low pressure sides of the vane, which channel is blocked as long as the wearing surface has a predetermined thickness, and opened when the wearing surface is thinner than the predetermined thickness.

8 Claims, 2 Drawing Sheets

HYDRAULIC VANE MACHINE

Figure 1:
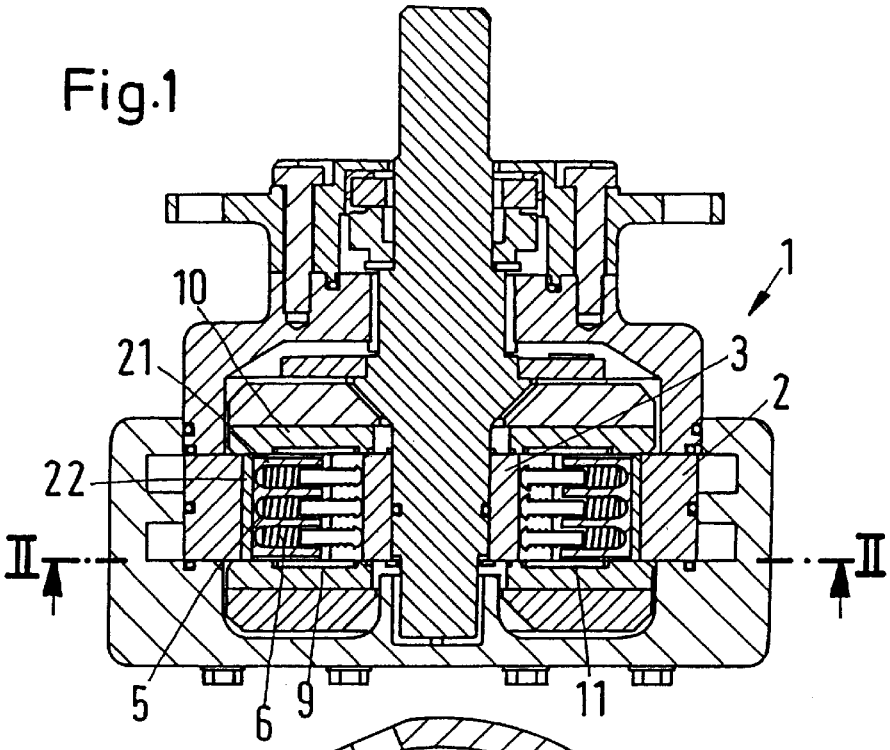

The invention concerns a hydraulic vane machine with one rotor, in which several vanes are arranged radially movable, and a stator having a stator bore, whose wall is made as a guiding contour on which the vanes bear.

Such machines can both be made as motors (U.S. Pat. No. 4,376,620 and U.S. Pat. No. 3,254,570) and as pumps (U.S. Pat. No. 3,255,704).

For convenience the following description is based on a motor.

In such a machine the guiding contour has working areas, in which the vanes are radially extended, and intermediary or resting areas, in which the vanes are radially retracted in the rotor. In the working areas in a motor a pressure difference is put across the vanes, e.g. in that one end of the working area is connected with a pump connection and the other end with a tank connection. The hydraulic pressure then acts on the extended vanes and produces the torque. With a pump, however, the extended vanes produce the hydraulic pressure.

Like for all hydraulic machines, it is also important for a vane machine to be tight, i.e. to have as few internal leakages as possible. Thus, special problems occur in areas in the machine, in which sealing must be maintained between movable parts. In a vane machine an especially critical area is the one in which the vanes bear on the guiding contour. To maintain the tightness here, the vanes must be pressed radially outwards with a certain force, to provide a corresponding bearing pressure against the guiding contour. This causes friction and consequently a wear. The wear is especially critical when hydraulic fluids with poor lubricating qualities are used, e.g. water.

It is the purpose of the invention to prolong the life of a machine.

In a hydraulic vane machine as mentioned in the introduction, this task is solved in that at least one vane has a wearing surface on the end bearing on the guiding contour, and that a channel arrangement is provided between high pressure and low pressure side of the vane, which channel is blocked as long as the wearing surface has a predetermined thickness, and opened when the wearing surface is thinner than the predetermined thickness.

The term "wearing surface" is a functional term, i.e. it must not be a separate part fixed on the vane, whose material has wear qualities different from those of the vane. The wearing surface can also simply be made by the area of the vane on this edge. However, the wearing surface can be selected from a material working together with the material of the guiding contour with as little friction as possible. If the stator and thus also the guiding contour are made of e.g. steel, the wearing surface could e.g. be made of a synthetic material from the group of high-strength thermo-plastic synthetic materials on the basis of polyaryl ether ketones. These materials could be e.g. polyether ether ketones, polyamides, polyacetalene, polyaryl ether, polyethylene terephthalate, polyvinylene sulphide, polysulphones, polyether sulphones, polyether imides, polyamid imides, polyacrylates, phenolic resins, such as novolack resin etc., by which glass, graphite, polytetra flourethylene or carbon, especially in fibre form, can be used as fillers. In this connection, especially the material polyether ether ketone (PEEK) has proved to be useful. When using such materials, also water can be used as hydraulic fluid. However, in spite of the low friction of the wearing surface, a certain wear eventually appears. The wearing surface can be made in one piece with the vane. However, usually, a metal reinforcement of the vane will be required to absorb the relatively high forces acting on the vane. When the wearing surface wears, this reinforcement may come to rest on the guiding contour, thus causing friction. This will soon result in permanent damage leading to a continuous failure of the whole machine. For economic reasons a reworking of the stator is often not expedient. To prevent this, the channel arrangement is provided between the high pressure and the low pressure side of the vane. The channel arrangement co-operates with the wearing surface in a way that at a certain wear degree of the wearing surface a "short-circuit" occurs between the high pressure and the low pressure side. This short-circuit is formed before the risk of a permanent damage of the stator occurs. In this case the machine stops. This gives the user a unambiguous signal that the machine needs repair. However, this repair can be made in a relatively simple way. Only the worn vanes must be replaced by new ones. Such a process is relatively easy to accomplish. In principle, wearing surfaces and channel arrangements on one, two or three vanes will be sufficient. E.g. an operation period of 1,000 or 10,000 hours can be pre-set, after which machine repairs are required. The machine will stop, when the short-circuit appears over the "control vane". Often, however, it will be advantageous to have all vanes made this way.

In a preferred embodiment the channel arrangement has at least one movable channel arranged in the vane, and at least one stationary channel arranged in the rotor. When the wearing surface falls below a predetermined thickness, the movable channel together with the stationary channel in the rotor creates a connection between the high pressure and the low pressure side of the vane. As the thickness or strength of the wearing surface is decisive for the extension of the vanes on rotation of the rotor, a control of the "short-circuit path" is relatively easy to accomplish by means of the movable channel.

Preferably, the movable channel has an opening on the high pressure side of the vane, which is covered by the rotor on intact wearing surface and retracted vane. The opening can be a bore creating a connection between the vane surface on the high pressure side and a channel arranged on the inside, e.g. a bore. However, it can also simply be a groove in the corresponding side of the vane forming the channel together with the rotor. In this embodiment the short-circuit on worn wearing surface is produced when the vane is in the intermediary area. As long as the wearing surface is intact, the movable channel is covered by the rotor. On the other hand, the channel is no longer covered by the rotor, when the wearing surface is worn. In this case hydraulic fluid can reach the low pressure side via the gap between rotor and stator and the channel.

Advantageously, the stationary channel is created in a sideplate of the rotor. This sideplate rotates together with the rotor. Arranging the channel here keeps both the high pressure side and the low pressure side of the vane free for the fitting of other control devices.

Advantageously, the stationary channel is closed by the vane, when the vane is extended. This applies for both the worn and the not-worn state of the wearing surface. In the extended state the vane is a working vane fully loaded by the pressure difference between high pressure and low pressure side. In this case a short-circuit should not occur. On the contrary short-circuits are limited to the intermediary area.

Preferably, at least one end surface of the vane has a recess opening towards the low pressure side and the end comprising the wearing surface, which recess extends radially inwards so far that on retracted vane it covers the stationary channel at least partly, on extended vane, however, creates no covering with the stationary channel. Thus, the stationary channel can be used for an additional purpose. When the vane is retracted, hydraulic fluid under pressure can reach the vane from the next pressure connection in rotation direction, and through the recess and the stationary channel it can reach the basis of the vane, so that the vane is pushed radially outwards. However, this only applies for the vane next to the pressure connection. As soon as the vane reaches the working area, or the commutation area, and extends, this pressure admission is, however, no longer required or wanted. The corresponding side of the vane is then exposed to the low pressure, so that the connection between this side and the basis must be interrupted. However, at the same time part of the short-circuit path can be formed via the recess, so that in the retracted state and with worn wearing surface a connection can be created between the high pressure and the low pressure side of the machine via the recess, the stationary channel and the movable channel.

Preferably, the guiding contour has at least one working area and at least one intermediary area, by which the spacings between the vanes in the circumferential direction and the lengths of the intermediary areas are adapted to each other in a way that at least in one rotor position only one vane is in the intermediary area. This ensures that on wear of the wearing surface of only one single vane the machine stops due to the short-circuit between high pressure and low pressure side. This short-circuit path is not closed by another vane, which is possibly not yet sufficiently worn.

Advantageously, the guiding contour has at least one commutation area in which the vanes are led from the outside to the inside, by which a low pressure connection is provided both at the beginning and at the end of the commutation area. Thus, it is possible to retract the vane without it being influenced by a force in the circumferential direction, as the pressure on both sides of the vane is the same. On the other hand, however, this embodiment also prevents that the short-circuit path, created on retracting the vane also with intact wearing surface, gets a negative influence on the machine performance, as long as the wearing surface is not yet correspondingly worn. This embodiment with low pressure connections in both ends of the commutation area causes that the short-circuit area can open shortly on retraction of the vane. However, due to the missing pressure difference across the short-circuit channel no hydraulic fluid can flow through this area.

In the following the invention is described on the basis of a preferred embodiment in connection with the drawings, showing:

FIG. 1 a longitudinal section through a hydraulic vane motor

Figure 2:
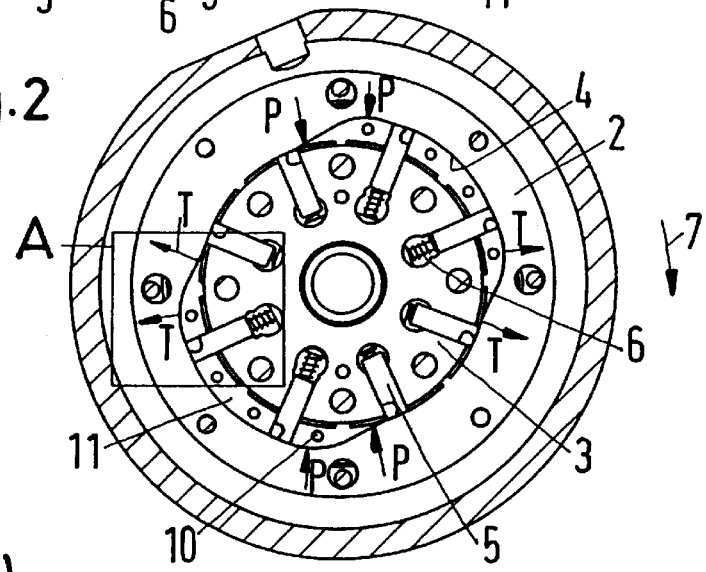

FIG. 2 a section II—II according to FIG. 1

FIG. 3*a*–3*d* are different views of a vane

Figure 4:
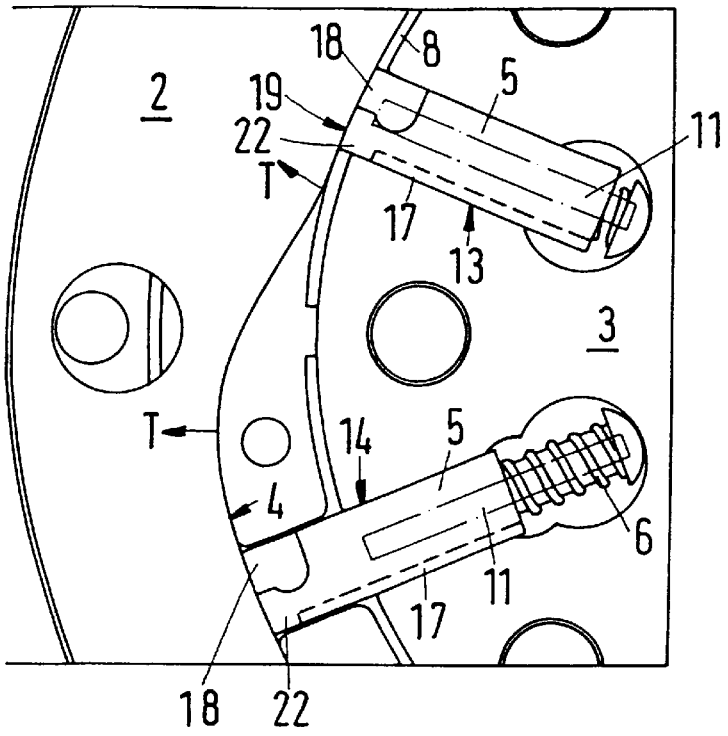

FIG. 4 enlarged section A from FIG. 2

Figure 5:
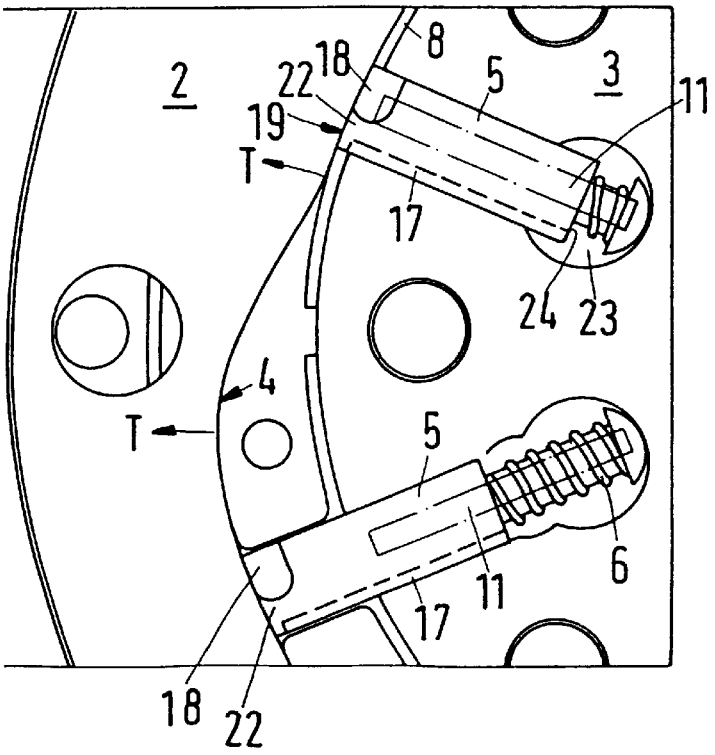

FIG. 5 same section with worn vanes.

A vane motor 1 has a stator 2, in which a rotor 3 is arranged rotatably. The stator 2 has a stator bore with a guiding contour 4, having in the embodiment shown two working areas with increased diameter and two intermediary areas, whose diameters are only slightly larger than the external diameter of the rotor 3.

Rotor 3 comprises several, in the present embodiment eight, vanes 5, which are radially movable in the rotor 3. Under the influence of springs 6 they bear on the guiding contour 4 of the stator 2.

Between the working areas and the intermediary areas of the guiding contour 4 there are commutation areas, in which the vanes 5 can be extended or retracted. Both in the beginning and in the end of each commutation area supply connections of the same kind are provided. In the rotation direction shown by the arrow 7 the working areas are supplied through the pressure connections P with hydraulic fluid, which can flow off again through the tank connections T at the end of the working areas.

As can be seen from the FIGS. 4 and 5, a small gap 8 exists also in the intermediary area between the stator 2 and the rotor 3. This means that also in the retracted state the vanes 5 do not flush with the surface of the rotor 3, however, project with the width of the gap 8 and bear on the guiding contour 4 of the stator 2.

The rotor 3 is provided with sideplates 9, 10 on both sides, which rotate together with the rotor. For each vane 5 these sideplates 9, 10 have a channel 11 co-operating with the front side 12 shown in FIG. 3*c*. The channel 11 is formed as a groove opening in the direction of the rotor 3. It is closed by the vane 5. To simplify the following explanation, the channels 11 in FIGS. 4 and 5 are dash-dotted. As the channels 11 are stationary in the rotor 3, they are called "stationary channels" in the following.

Figure 3A:
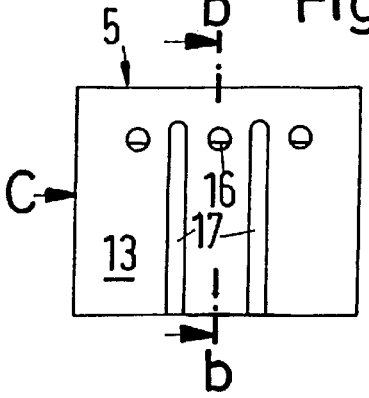
Figure 3B:
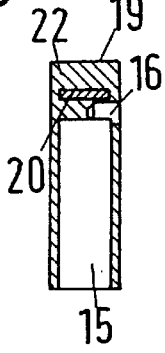
Figure 3C:
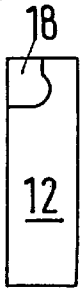
Figure 3D:
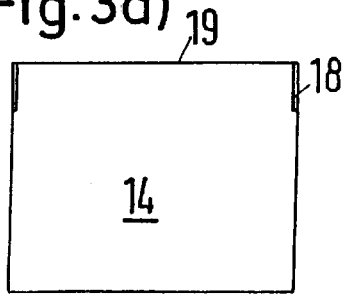

FIG. 3 shows a vane 5 from different sides, viz., FIG. 3*a* shows the high pressure side 13, FIG. 3*b* is a section b—b of FIG. 3*a*, FIG. 3*c* is the front side 12 already mentioned in view c from FIG. 3*a* and FIG. 3*d* shows the low pressure side 14 of the vane 5. The terms "high pressure side" and "low pressure side" particularly apply for the operation as motor.

The vane 5 has bores 15 running in the radial direction, which receive the springs 6. Through bores 16 running vertically to the high pressure side 13, the bores 15 are connected with the high pressure side 13. Further, surface grooves 17 are provided in the high pressure side 13, which are covered by the rotor 3, by which the degree of covering depends on the radial position of the vanes 5 in relation to the rotor. To simplify the description, the surface grooves 17 are shown with dotted lines in FIGS. 4 and 5. Here it can also be seen that the covering of the surface grooves 17 by the rotor 3 also depends on the degree of wear of the vane 5.

On each end side 12 the vane 5 has an additional recess 18 opening towards the low pressure side 14. Further, the recess 18 is connected with the edge 19, with which the vane 5 bears on the guiding contour 4.

FIG. 3*d* shows that the vane 5 is made in one piece of a synthetic material, in this case polyether ether ketone (PEEK), with a steel reinforcement 20. FIG. 1 shows that the vane is made in two pieces, by which a radially internal part 21 is made of steel, which is provided with a wearing surface 22 on the radially external part. In FIG. 3*b* the wearing surface 22 is formed by the radially external end. Correspondingly, the wearing surface extends from the edge 19 to the reinforcement 20.

The motor 1 works as follows: Hydraulic fluid, e.g. water, is led to the pressure connections P under pressure. On one side the hydraulic fluid now flows against the rotation direction (arrow 7) through the gap 8. Via the recess 18, which is partly covered by the channel 11, under the vane 5 being the next to reach the pressure connection P, the hydraulic fluid reaches its basis 24 and presses the vane radially outwards against the guiding contour 4. Thus the pressure connection P is sealed against the tank connection T being next in the rotation direction.

When the vane 5 has passed the first pressure connection P of the commutation area, it has the same pressure on the high pressure side 13 and the low pressure side 14. Due to the hydraulic fluid still reaching its basis 24 via the recess 18 and the channel 11, the vane 5 is displaced further outwards. For this purpose it is also supported by the spring 6. Before the end of the covering of the recess 18 and the channel 11, however, the bore 16 or the surface groove 17, respectively, gets out of the rotor 3, so that the hydraulic fluid can reach the pressure chamber 23 arranged in the basis 24 of the vane 5 in this way, i.e. both through the bores 15, 16 and through the surface grooves 17. Thus the vane 15 is continuously pressed against the guiding contour 4. When the vane 5 has left the commutation area with the two pressure connections P, the pressure from the pump connections P is ruling on the high pressure side 13. As long as the leading vane has not yet passed the following tank connection T, the high pressure is enclosed in the cell between the two vanes 5. However, as soon as the next vane 5 has passed the tank connection T, a pressure difference occurs, as then the tank pressure rules on the low pressure side 14 of the vane 5. This pressure difference produces the torque required for moving the rotor 3.

As soon as the vane 5 has passed the first tank connection T, the hydraulic fluid can flow away from the basis through the bores 15, 16 or the surface grooves 17, respectively, and the vane 5 can be retracted.

Due to the pressures, with which the vanes 5 are pressed against the guiding contour 4, a wear, i.e. an abrasion, occurs on the edge 19. This is shown in the FIGS. 4 and 5. It can be seen that the wearing surface 22 gets thinner, i.e. in FIG. 5 the vane 5 is extended radially farther out.

Now, the following happens: In FIG. 4 the surface groove 17 (the same applies correspondingly for the bore 16) is closed by the rotor 3, when the vane 5 is retracted in the rotor. It is possible that hydraulic fluid, flowing through the gap 8, reaches the basis 24 of the vane 5 through the recess 18 and the channel 11, and presses the vane radially outwards. However, a further advance of the hydraulic fluid is practically impossible. The reason for this is that the vane 5 is pressed anti-clockwise against the stator 3, so that an advance of hydraulic fluid on the high pressure side 13 of the vane 5 is practically no longer possible.

When the vane 5 is extended (in FIG. 4 the lower vane), the surface groove 17 is in connection with the high pressure, so that hydraulic fluid can reach the basis 24 of the vane 5 and press it against the guiding contour 4. However, a further advance of the hydraulic fluid is not possible, as the low pressure side 14 is pressed against the rotor 3.

However, the situation is different, when the wearing surface 22 is worn, i.e. its thickness is reduced.

In this case the surface groove 17 is still in connection with the gap 8, also when the vane 5 is pressed as far into the rotor as possible by the guiding contour 4. However, at the same time the recess 18 is also still in connection with the channel 11, so that a short-circuit path occurs, which is formed by the gap 8, the recess 18, the channel 11, the pressure chamber 23 on the basis 24 of the vane and the surface grooves 17. In this case hydraulic fluid can flow from the pump connection P to the tank connection T. This fluid flow is somewhat throttled, as the short-circuit channel 8, 18, 11, 23, 17 offers a certain flow resistance. However, the performance of the machine clearly shows that there has been a short-circuit. In most cases this causes that the motor 1 stops. Thus the operator will know that the vanes 5 must be replaced.

It can be seen that for the channel arrangement only such channels are required, which are also required for the pressure control of the vanes 5. The reduction of the wearing surface only controls the opening of these channels.

During regular operation, i.e. with intact wearing surface 22, the short-circuit path will open shortly, both on retraction and on extension of the vanes 5. This is not critical, however, as the same pressure rules on both sides of the vane 5. This embodiment even has the advantage that a closed chamber can never occur under the vane 5, in which an undesired pressure could build up.

We claim:

1. Hydraulic vane machine comprising one rotor having several vanes arranged radially movable and a stator having a stator bore, the stator bore having a wall comprising a guiding contour on which the vanes bear, at least one vane having a wearing surface on its end bearing on the guiding contour, a channel arrangement located between high pressure and low pressure sides of the vane, the channel arrangement being blocked to prevent communication between the high pressure and low pressure sides of the vane as long as the wearing surface has at least a predetermined thickness, and opened to permit communication between the high pressure and low pressure sides of the vane when the wearing surface is thinner than the predetermined thickness.

2. Machine according to claim 1, in which the channel arrangement includes at least one movable channel located in the vane, and at least one stationary channel in the rotor.

3. Machine according to claim 2, in which the movable channel has an opening on the high pressure side of the vane, the opening being covered by the rotor when the wearing surface is greater than the predetermined thickness and the vane is retracted.

4. Machine according to claim 2, in which the stationary channel is located in a sideplate of the rotor.

5. Machine according to claim 2, in which the stationary channel is closed by the vane, when the vane is extended.

6. Machine according to claim 5, in which at least one end surface of the vane has a recess opening toward the low pressure side and toward the wearing surface, which recess extends radially inwardly such that on retraction of the vane the recess covers the stationary channel at least partly and on extension of the vane the recess does not cover the stationary channel.

7. Machine according to claim 1, in which the guiding contour has at least one working area and at least one intermediary area, and spacings between the vanes in the circumferential direction and the length of the intermediary area being such that at least in one position of the rotor only one vane is in the intermediary area.

8. Machine according to claim 1, in which the guiding contour has at least one commutation area in which the vanes are retracted, and having a low pressure connection both at a beginning and at an end of the commutation area.

* * * * *